US009633598B2

(12) United States Patent
Okuno et al.

(10) Patent No.: US 9,633,598 B2
(45) Date of Patent: Apr. 25, 2017

(54) PIXEL CIRCUIT AND DRIVING METHOD THEREOF

(71) Applicant: SAMSUNG DISPLAY CO., LTD., Yongin, Gyeonggi-Do (KR)

(72) Inventors: Takeshi Okuno, Yokohama (JP); Masayuki Kumeta, Yokohama (JP); Eiji Kanda, Yokohama (JP); Ryo Ishii, Yokohama (JP); Naoaki Komiya, Yokohama (JP)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 114 days.

(21) Appl. No.: 14/269,709

(22) Filed: May 5, 2014

(65) Prior Publication Data

US 2014/0333682 A1 Nov. 13, 2014

(30) Foreign Application Priority Data

May 7, 2013 (JP) ..... 2013-097948

(51) Int. Cl.
*G09G 3/32* (2016.01)
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0861* (2013.01); *G09G 2310/0251* (2013.01); *G09G 2320/045* (2013.01)

(58) Field of Classification Search
CPC ..... G09G 3/32–3/3291; G09G 2300/0842; G09G 2300/0861; G09G 2300/0866; G09G 2310/0243; G09G 2310/0248–2310/0256; G09G 2310/0264–2310/0272; G09G 2320/045
See application file for complete search history.

(56) References Cited

U.S. PATENT DOCUMENTS

2007/0046601 A1* 3/2007 Shin ..... G09G 3/3607 345/89
2008/0150846 A1* 6/2008 Chung ..... G09G 3/3233 345/80

(Continued)

FOREIGN PATENT DOCUMENTS

JP 2006-146201 6/2006
JP 2008-170788 7/2008

(Continued)

*Primary Examiner* — Nathan Danielsen
(74) *Attorney, Agent, or Firm* — Lee & Morse, P.C.

(57) ABSTRACT

A method for driving a display device includes driving a first pixel circuit based on first and second fields of a frame, and driving a second pixel circuit based on first and second fields of the frame. The first field of the first pixel circuit overlaps the second field of the second pixel circuit. The second field of the first pixel circuit overlaps the first field of the second pixel circuit. Operations performed in the first field include storing a gray scale data voltage, and operations performed in the second field include supplying an amount of current to a light emitter based on the stored gray scale data voltage. The first and second pixel circuits are in adjacent rows of the display device.

20 Claims, 17 Drawing Sheets

(56) References Cited

U.S. PATENT DOCUMENTS

| | | | | |
|---|---|---|---|---|
| 2009/0121981 | A1* | 5/2009 | Yoo | G09G 3/3233 345/76 |
| 2009/0284515 | A1* | 11/2009 | Tsuge | G09G 3/3233 345/76 |
| 2011/0102403 | A1* | 5/2011 | Kim | G09G 3/3233 345/211 |
| 2011/0310077 | A1* | 12/2011 | Hwang | G09G 3/3233 345/76 |

FOREIGN PATENT DOCUMENTS

| | | | |
|---|---|---|---|
| JP | 2009-235328 | A | 10/2009 |
| JP | 2009-258227 | A | 11/2009 |
| JP | 2009-265328 | A | 11/2009 |
| JP | 2009-276744 | A | 11/2009 |
| JP | 2011-247981 | | 12/2011 |
| JP | 2012-093688 | | 5/2012 |
| JP | 2013-061452 | | 4/2013 |

* cited by examiner (A) Initialization Period (B) Data Line Charging Period (C) Vth Compensation Period

PIXEL CIRCUIT AND DRIVING METHOD THEREOF

CROSS-REFERENCE TO RELATED APPLICATION

Japanese Patent Application No. 2013-097948, filed on May 7, 2013, and entitled, "Pixel Circuit and Driving Method Thereof," is incorporated by reference herein in its entirety.

BACKGROUND

1. Field

One or more embodiments described herein relate to a pixel circuit.

2. Description of the Related Art

A variety of flat panel displays have been developed. Liquid crystal displays and organic electro luminescence (EL) displays are two of the most popular, and have been to replace cathode ray tube displays. In particular, the organic EL display has gotten a lot of attention because of its slim size and low-power consumption.

In an organic EL display, the amount of current to be supplied to a light emitting diode is adjusted by controlling a driving transistor of a pixel circuit. A gray scale value of light is emitted based on the adjusted amount of current. Unfortunately, during operation, variations in the characteristics of the driving transistor of each pixel reduce display quality.

SUMMARY

In accordance with one embodiment, a method of driving a display device includes driving a first pixel circuit and a second pixel circuit based on a frame which includes a first field and a second field, the first field of the first pixel circuit overlapping the second field of the second pixel circuit, and the second field of the first pixel circuit overlapping the first field of the second pixel circuit. Operations performed during the first field include supplying an initialization voltage to a gate electrode of a first transistor by turning on a fourth transistor, supplying a gray scale data voltage to a data line, the gray scale data voltage applied to the gate electrode of the first transistor by turning on a second transistor, and blocking supply of a power supply voltage to an emission element by turning off a third transistor. Operations performed during the second field include supplying the power supply voltage to the data line by turning on the third transistor, the emission element coupled to the data line to emit light based on the power supply voltage, and the first and second pixel circuits are in different rows.

Each of the first and second pixel circuits may include a capacitive element connected between the gate electrode of the first transistor and the initialization voltage, the initialization voltage may include a first initialization voltage supplied in the first field and a second initialization voltage supplied in the second field, and the method may include changing the second initialization voltage to vary a potential of the gate electrode of the first transistor connected to the capacitive element, to reduce an amount of current flowing through the first transistor. The first pixel circuit may be in an odd-numbered row, and the second pixel circuit may be an even-numbered row.

In accordance with another embodiment, a method of driving a display device includes driving a first pixel circuit and a second pixel circuit based on a frame which includes a first field and a second field, the first field of the first pixel circuit overlapping the second field of the second pixel circuit, and the second field of the first pixel circuit overlapping the first field of the second pixel circuit. Operations performed during the first field include supplying an initialization voltage to a gate electrode of a first transistor by turning on a third transistor, supplying a gray scale data voltage to a data line, the gray scale data voltage applied to the gate electrode of the first transistor by turning on a second transistor, and controlling a first power supply voltage of a first state to place an emission element in a non-emission state. Operations performed during the second field include supplying a second power supply voltage to the data line, and controlling the first power supply voltage of in a second state to place the emission element in an emission state, and the first and second pixel circuits are in different rows.

Each of the first and second pixel circuits may include a capacitive element connected between the gate electrode of the first transistor and the initialization voltage, the initialization voltage may include a first initialization voltage supplied during the first field and a second initialization voltage supplied during the second field, and the method may include changing a voltage of the second initialization voltage to vary a potential of the gate electrode of the first transistor connected to the capacitive element, to reduce an amount of current flowing through the first transistor. The first pixel circuit may be in an odd-numbered row, and the second pixel circuit may be in an even-numbered row.

In accordance with another embodiment, a method of driving a display device includes driving a first pixel circuit based on first and second fields of a frame; and driving a second pixel circuit based on the first and second fields of the frame, the first field of the first pixel circuit overlapping the second field of the second pixel circuit, and the second field of the first pixel circuit overlapping the first field of the second pixel circuit, wherein operations performed in the first field include storing a gray scale data voltage, wherein operations performed in the second field include supplying an amount of current to a light emitter based on the stored gray scale data voltage, and wherein the first and second pixel circuits are in different rows. The first pixel circuit may be in an odd row, and the second pixel circuit may be in an even row.

Operations performed in the first field may include supplying the gray scale data voltage to a data line, and operations performed in the second field may include supplying a power source voltage to the data line. The data voltage may be supplied to the data line based on a first gate control signal, and the power source voltage is supplied to the data line based on a second gate control voltage.

The gray scale data voltage may be supplied to the data line of the first pixel circuit in the first field when the power supply voltage is supplied to the data line of the second pixel circuit the second field, and the gray scale data voltage may be supplied to the data line of the second pixel circuit in the first field when the power supply voltage is supplied to a data line of the first pixel circuit the second field.

In accordance with another embodiment, an apparatus includes a first switching circuit to selectively output a first gray scale data voltage or a first power source voltage to a first pixel circuit; a second switching circuit to selectively output second gray scale data voltage or the first power source voltage to a second pixel circuit, wherein: the first and second pixel circuits are in adjacent rows; the first switching circuit is to output the first gray scale data voltage to the first pixel circuit while the second switching circuit is to output the first power source voltage to the second pixel circuit, and the second switching circuit is to output the second gray scale data voltage to the second pixel circuit while the first switching circuit is to output the first power source voltage to the first pixel circuit.

The first switching circuit may output the first gray scale data voltage and the second switching circuit may output the first power source voltage based on a first control signal. The first switching circuit may output the first power source voltage and the second switching circuit may output the second gray scale data voltage based on a second control signal.

The first pixel circuit may be in a light emission state while the second pixel circuit is in a light non-emission state, and the first pixel circuit may be in a light non-emission state when the second pixel circuit is in a light emission state. Each of the first pixel circuit and the second pixel circuit may be placed in a light emission state based on a change in potential of a second power voltage source.

The first pixel circuit may receive a first initialization voltage, and the second pixel circuit may receive a second initialization voltage different from the first initialization voltage, the first and second initialization voltages to reset respective ones of the first and second pixel circuits.

The first and second pixel circuits may be in a same column. The apparatus may include a data driver including the first and second switching circuits. A driving transistor of each of the first and second pixel circuits may be placed in a diode-connected state based on respective gray scale data voltages.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
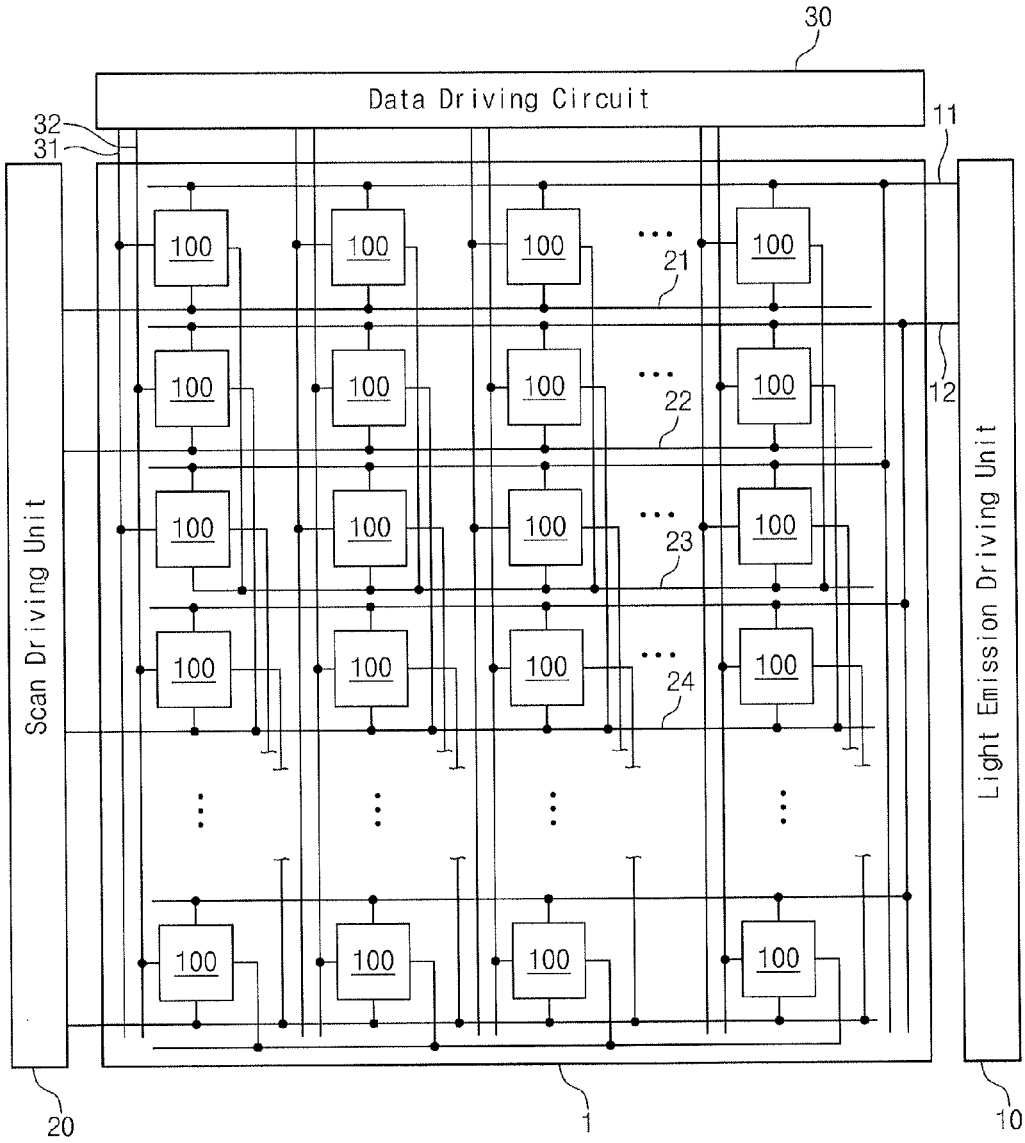
FIG. 1 illustrates an embodiment of a light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

FIG. 1 illustrates an embodiment of a light emitting display device which includes a plurality of pixel circuits 100, a light emission driving unit 10, a scan driving unit 20, and a data driving unit 30. The pixel circuits 100 are disposed in an n×m matrix shape (n and m being integers greater than 0). Each pixel circuit 100 may be controlled by light emission driving unit 10, scan driving unit 20, and data driving unit 30. For example, if n=3, n indicates a group of pixel circuits disposed along a third row. If m=3, m indicates a group of pixel circuits disposed along a third column.

The light emission driving unit 10 controls timing of when a power supply voltage is supplied. The light emission driving unit 10 supplies emission control signals EM(odd) and EM(even) to emission control lines 11 and 12 that correspond to rows of pixel circuits 100.

The scan driving unit 20 may be a driving circuit that selects a row where a data write operation is to be executed. The scan driving unit 20 supplies gate control signals SCAN(n) sequentially to gate control lines 21 to 24, that are provided to correspond to rows of pixel circuits 100. Thus, pixel circuits 100 are selected sequentially by the row.

The data driving unit 30 may be a driving circuit that decides gray scale values based on input image data. Data voltages corresponding to decided gray scale values are supplied to pixel circuits 100. In this embodiment, two data lines 31 and 32 are provided to correspond to each column of pixel circuits 100. Odd-numbered rows of pixel circuits 100 are connected to the data line 31, and even-numbered rows of pixel circuits 100 are connected to the data line 32.

For example, data signals DTa(m) and DTb(m) are supplied to data lines 31 and 32, respectively. Data signals DTa(m) and DTb(m) include a gray scale data voltage Vdata(m) of a pixel and an anode power ELVDD for supplying current to an emission element. The gray scale data voltage Vdata(m) and anode power ELVDD may be generated from a switch circuit in data driving circuit 30.

Figure 2:
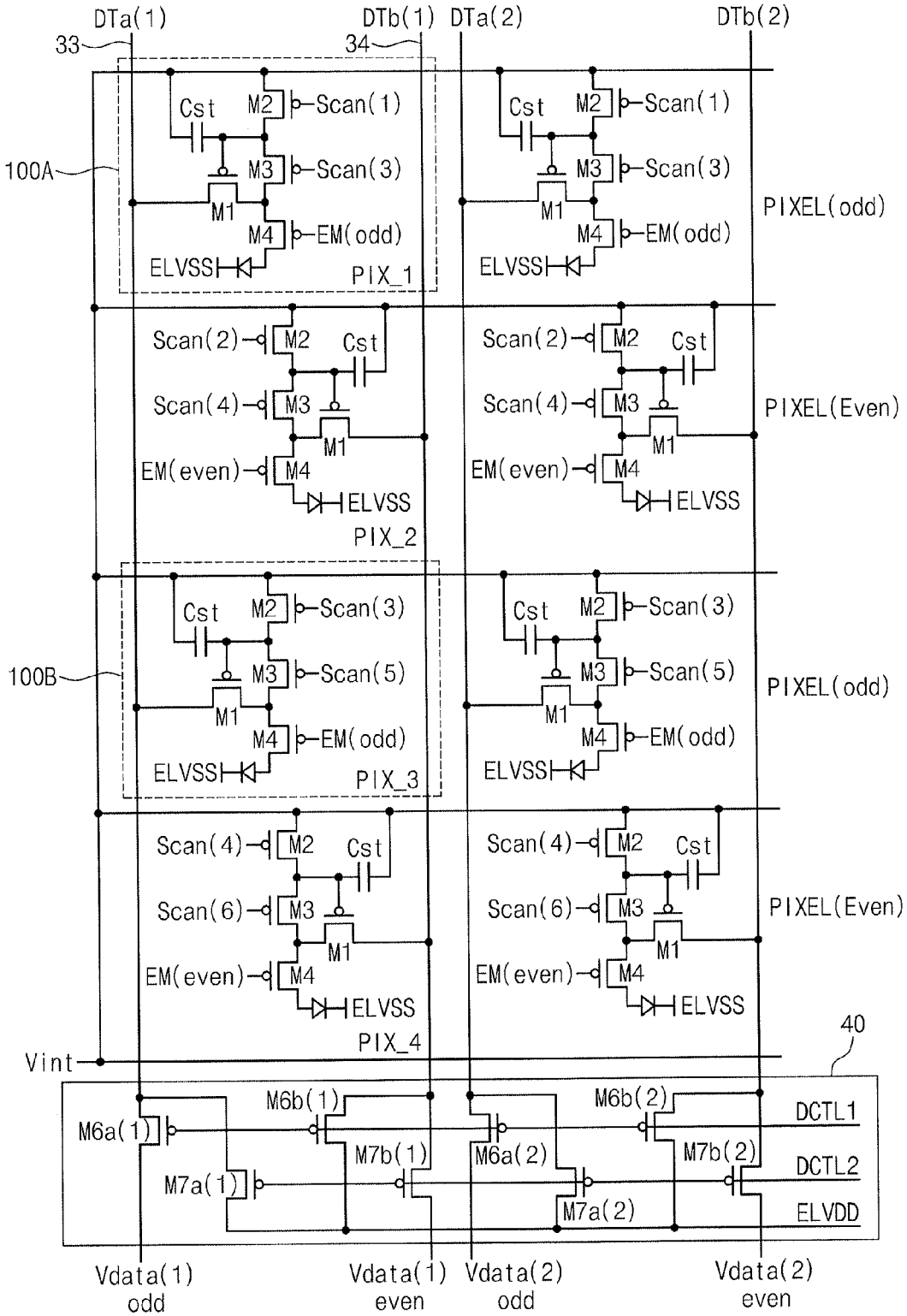
FIG. 2 illustrates another embodiment of a light emitting display device.

FIG. 2 is a circuit diagram of another embodiment of a light emitting display device which includes pixel circuit 100 in FIG. 1 and a switching circuit 40 in data driving unit 30. Transistors of the pixel circuit 100 shown in FIG. 2 may be, for example, p-channel transistors.

Referring to FIG. 2, a pixel circuit 100A is located at the first column (m=1) and the first row (n=1) and a pixel circuit 100B is located at the first column (m=1) and the third row (n=3). A switch transistor M3 of pixel circuit 100A and a switch transistor M2 of pixel circuit 100B are simultaneously controlled by scan signal Scan(3).

Emission transistors M4 of pixel circuits PIXEL(odd) in odd-numbered rows are controlled simultaneously by emission control signal EM(odd). Emission transistors M4 of pixel circuits PIXEL(even) in even-numbered rows are controlled simultaneously by emission control signal EM(even). With this circuit structure, pixel circuits in even-numbered rows and pixel circuits in odd-numbered rows emit light, in turn, based on the emission control signals.

The switching circuit 40 is provided with gray scale data voltages Vdata(m)odd and Vdata(m)even and an anode power supply voltage ELVDD. The switching circuit 40 is controlled by two gate control signals DCTL 1 and DCTL2.

When transistors M6*a*(1), M6*b*(1), M6*a*(2), and M6*b*(2) are turned on by gate control signal DCTL1, gray scale data voltage Vdata(m)odd is supplied to pixel circuits PIXEL (odd) in odd-numbered rows and anode power supply voltage ELVDD is supplied to pixel circuits PIXEL(even) in even-numbered rows. In this case, the gray scale data voltage Vdata(m)odd may be written at pixel circuits PIXEL (odd) in the odd-numbered rows, and light emitting elements of pixel circuits PIXEL(even) in the even-numbered rows may emit light.

When transistors M7*a*(1), M7*b*(1), M7*a*(2), and M7*b*(2) are turned on by gate control signal DCTL2, the anode power supply voltage ELVDD is supplied to pixel circuits PIXEL(odd) in the odd-numbered rows and gray scale data voltage Vdata(m)even is supplied to pixel circuits PIXEL (even) in the even-numbered rows. In this case, the gray scale data voltage Vdata(m)even may be written at pixel circuits PIXEL(even) in the even-numbered rows, and light emitting elements of pixel circuits PIXEL(odd) in the odd-numbered rows may emit light.

Figure 3:
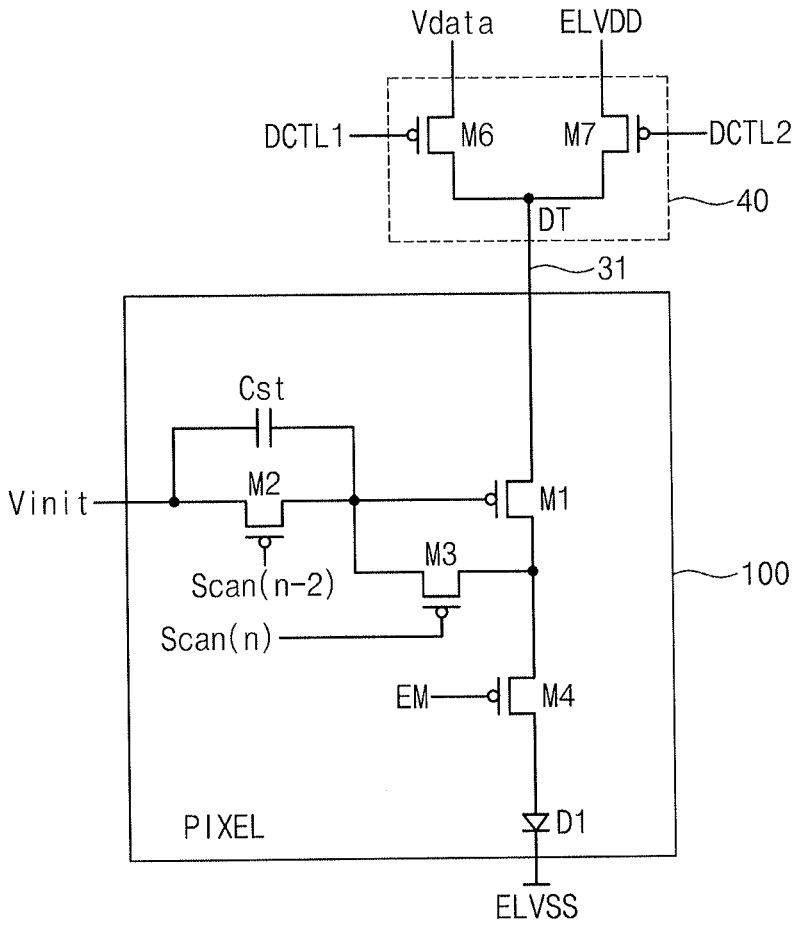
FIG. 3 illustrates an embodiment of a unit pixel.

FIG. 3 is an embodiment of a unit pixel, which, for example, may be included in any of the aforementioned embodiments of the display device. Referring to FIG. 3, the pixel circuit includes four transistors and one capacitive element. For example, the pixel circuit includes a driving transistor M1, switch transistors M2 and M3, an emission transistor M4, a capacitive element Cst, and an emission diode D1. The emission diode D1 may include a diode and parasitic capacitance.

The transistors of the pixel circuit in FIG. 3 are illustratively shown as p-channel transistors. A cathode electrode of emission element D1 is connected to a cathode power supply voltage EVLSS. A gate electrode of driving transistor M1 is connected to an initialization voltage Vint, via switch transistor M2. The switch transistor M3 is connected between the gate electrode and a source/drain electrode of driving transistor M1.

The gate electrode of driving transistor M1 is connected to one electrode of capacitive element Cst that stores a voltage corresponding to gray scale data. The other electrode of capacitive element Cst is connected to initialization voltage Vint. The emission transistor M4 is connected between one of the source and drain electrodes of driving transistor M1 and an anode electrode of emission element D1. The other of the source and drain electrodes of driving transistor M1 is connected to data line 31. The driving transistor M1 may control the amount of current to be supplied to the emission element D1 based on voltage supplied to the gate electrode of driving transistor M1.

In one embodiment, sSignals for operating a pixel circuit may be voltage signals indicating logical levels, such as a low level and a high level. Also, a transistor in a conducting state corresponds to a turn-on state of the transistor, and a transistor in a non-conducting state corresponds to a turn-off state of the transistor.

FIGS. 4A to 4D illustrate operation of the unit pixel of FIG. 3 in different periods according to one embodiment. FIG. 5 is an embodiment of a timing diagram for this unit pixel. Referring to FIGS. 4A to 4D, the different periods of operation for driving the unit pixel may include an initialization period (A), a data line charging period (B), a threshold voltage compensation period (C), and an emission period (D).

The initialization period (A), data line charging period (B), threshold voltage compensation period (C), and emission period (D) may correspond to an initialization period (A), data line charging period (B), threshold voltage compensation period (C), and emission period (D) in FIG. 5. The timing diagram in FIG. 5 shows examples of potentials of nodes. An M1 source waveform corresponds to a potential of a source of a driving transistor M1 in FIGS. 4A to 4D. The M1 gate waveform corresponds to a potential of a gate of driving transistor M1 in FIGS. 4A to 4D.

Initialization Period (A)

Figure 4A:
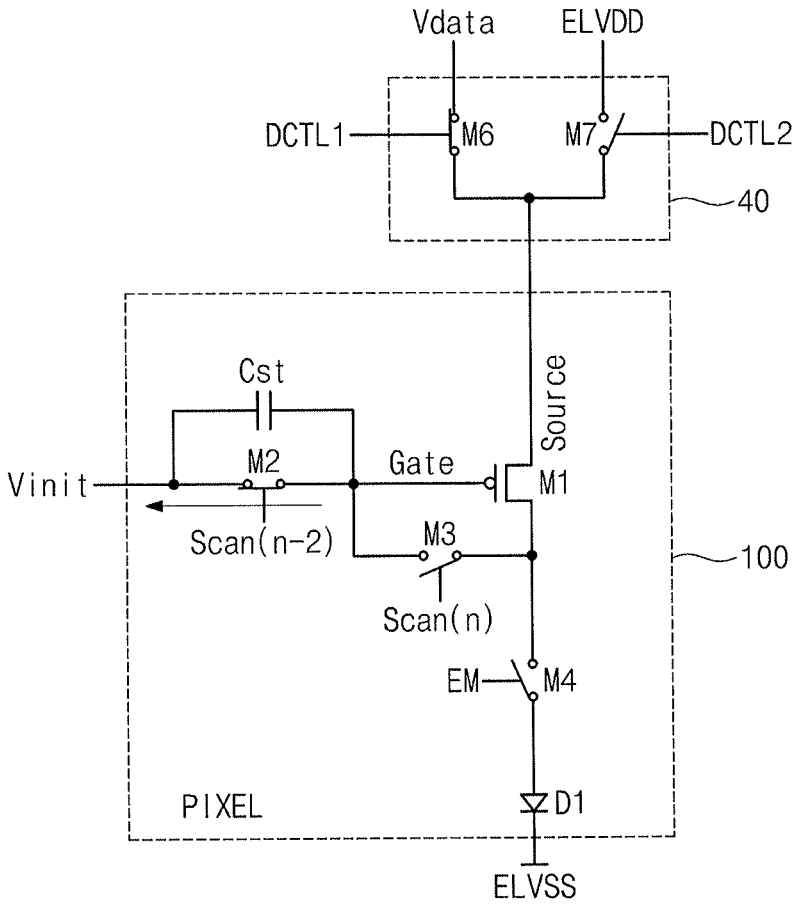
FIGS. 4A-4D illustrate operations of a unit pixel according to one embodiment.
Figure 5:
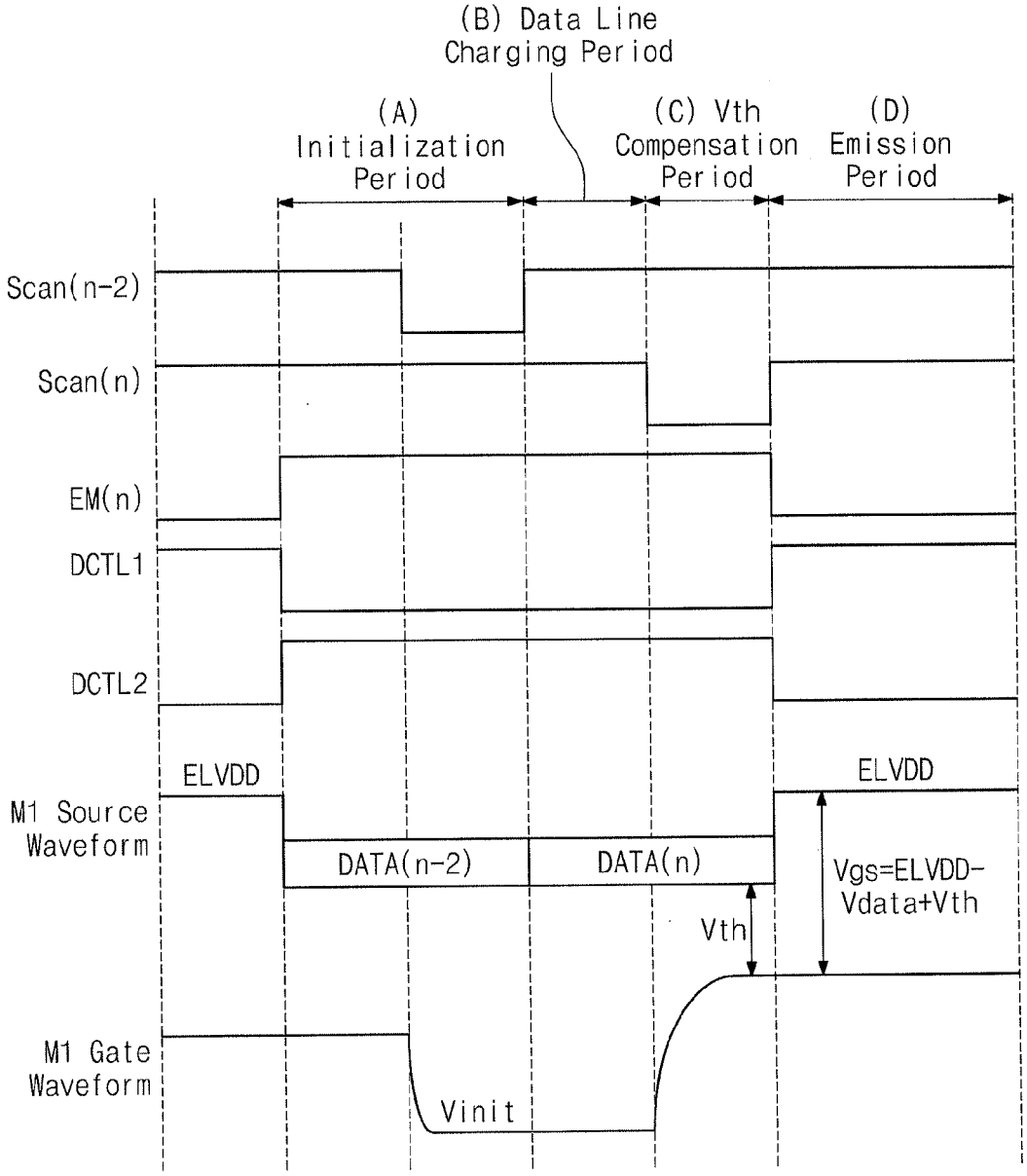
FIG. 5 illustrates an embodiment of a timing diagram for a unit pixel.

Referring to FIGS. 4A and 5, when a gate control signal Scan(n−2) has a low level, a switch transistor M2 is turned on. At this time, a gate electrode of a driving transistor M1 is connected to an initialization voltage Vint. As a result, pixel circuit 100 is reset. At this time, gate control signal DCTL1 of switching circuit 40 has a low level and gate control signal DCTL2 has a high level. Thus, gray scale data voltage Vdata(n−2) is supplied to a data line. As the gate control signal Scan(n−2) transitions to a high level, switch transistor M2 is turned off. This may be considered to be a termination point of resetting pixel circuit 100.

Data Line Charging Period (B)

Figure 4B:
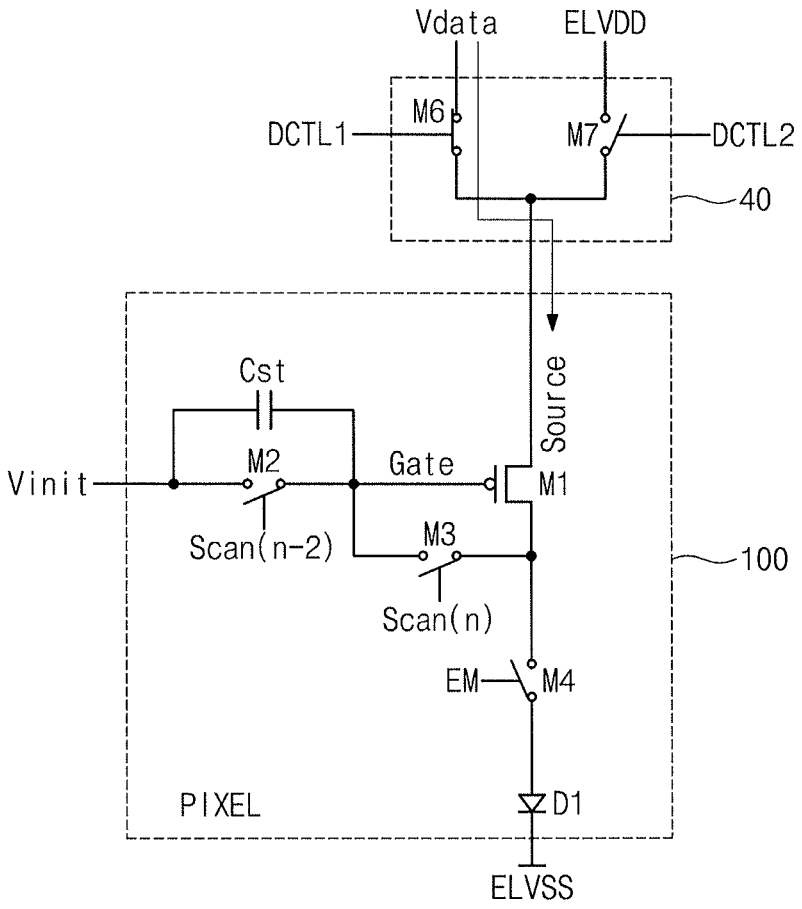

Referring to FIGS. 4B and 5, gate control signal DCTL1 of switching circuit 40 has a low level and gate control signal DCTL2 has a high level. A gray scale data voltage Vdata(n) of a pixel circuit is supplied to a data line. For example, the data line is charged. A source potential of driving transistor M1 is stabilized to the gray scale data voltage Vdata(n) thus supplied.

Threshold Voltage Compensation Period (C)

Figure 4C:
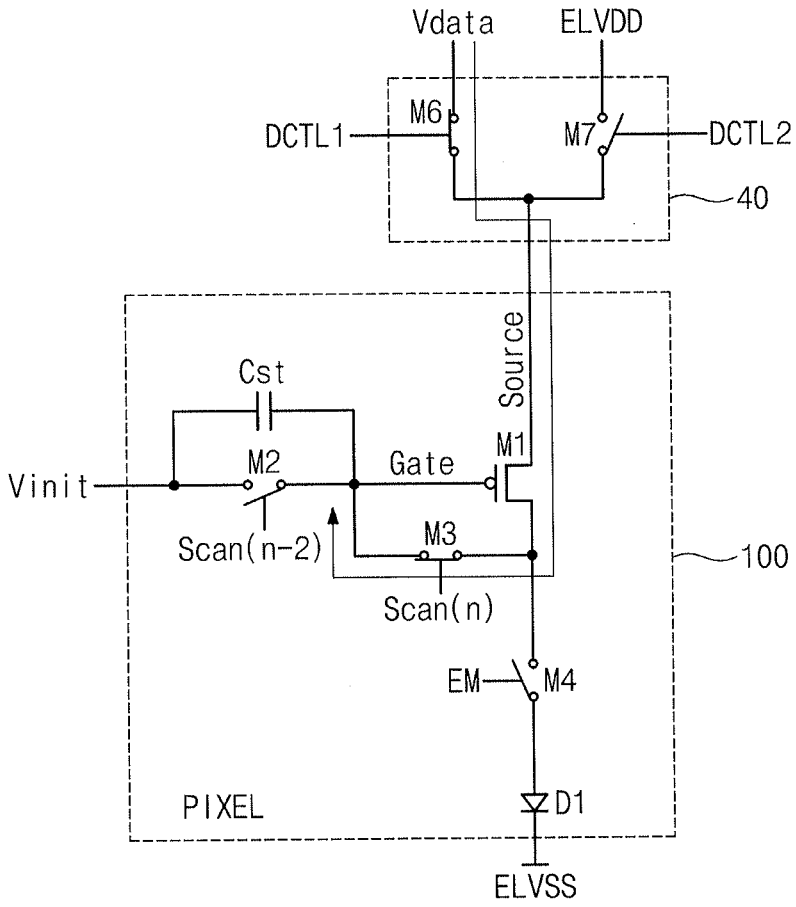

Referring to FIGS. 4C and 5, as gate control signal Scan(n) transitions to a low level, switch transistor M3 is turned on. The gray scale data voltage Vdata(n) supplied to the data line is transferred to the gate electrode of driving transistor M1 through driving transistor M1 and switch transistor M3. Because switch transistor M3 is connected between the gate electrode and a drain or source electrode of driving transistor M1, the driving transistor M1 is diode connected. In this case, the gate electrode of driving transistor M1 is supplied with a voltage which corresponds to (Vdata−Vth), where Vdata is the gray scale data voltage and Vth is the threshold voltage of driving transistor M1.

This operation is referred to as a threshold voltage compensation operation. The threshold voltage compensation operation may make it possible to suppress influence due to variation in the threshold voltage of the driving transistor M1 and to accurately control an amount of current flowing, via emission element D1, as a data signal. As a gate control signal Scan(n) transitions to a high level, switch transistor M3 of the pixel circuit 100 is turned off, thereby ending the threshold voltage compensation operation.

Emission Period (D)

Figure 4D:
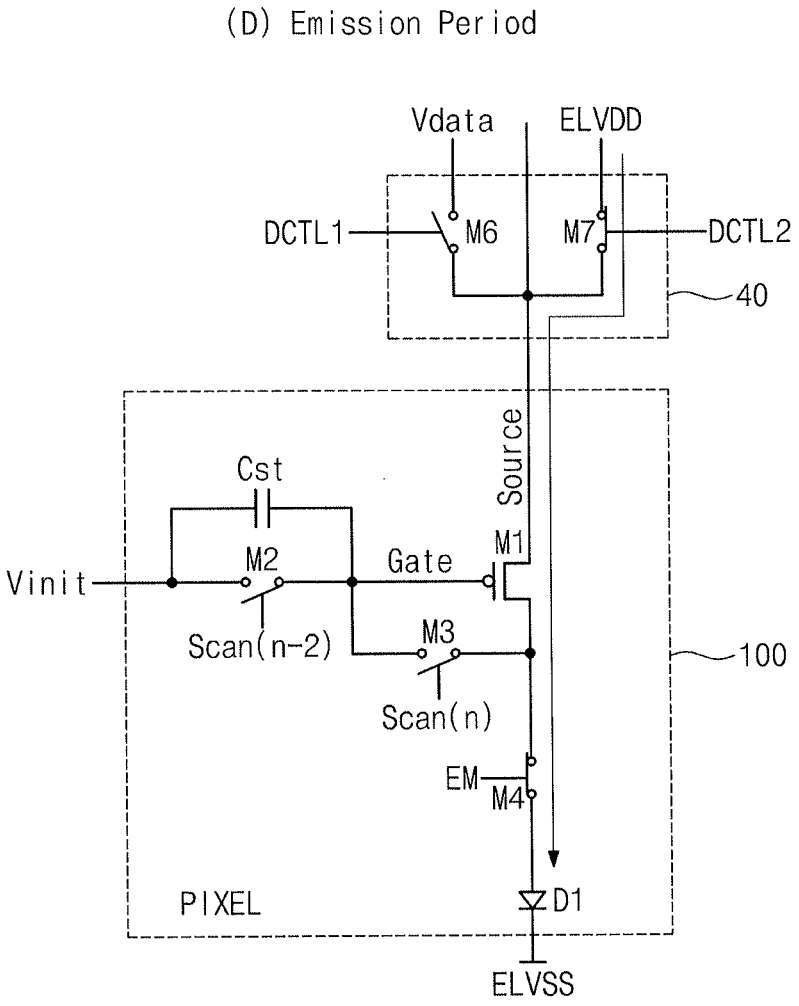

Referring to FIGS. 4D and 5, as gate control signal DCTL1 of the switching circuit 40 transitions to a high level and gate control signal DCTL2 transitions to a low level, anode power supply voltage ELVDD is supplied to the data line. The anode power supply voltage ELVDD on the data line is transferred to emission element D1 via driving transistor M1 and emission transistor M4. As a result, emission element D1 emits light.

Figure 6:
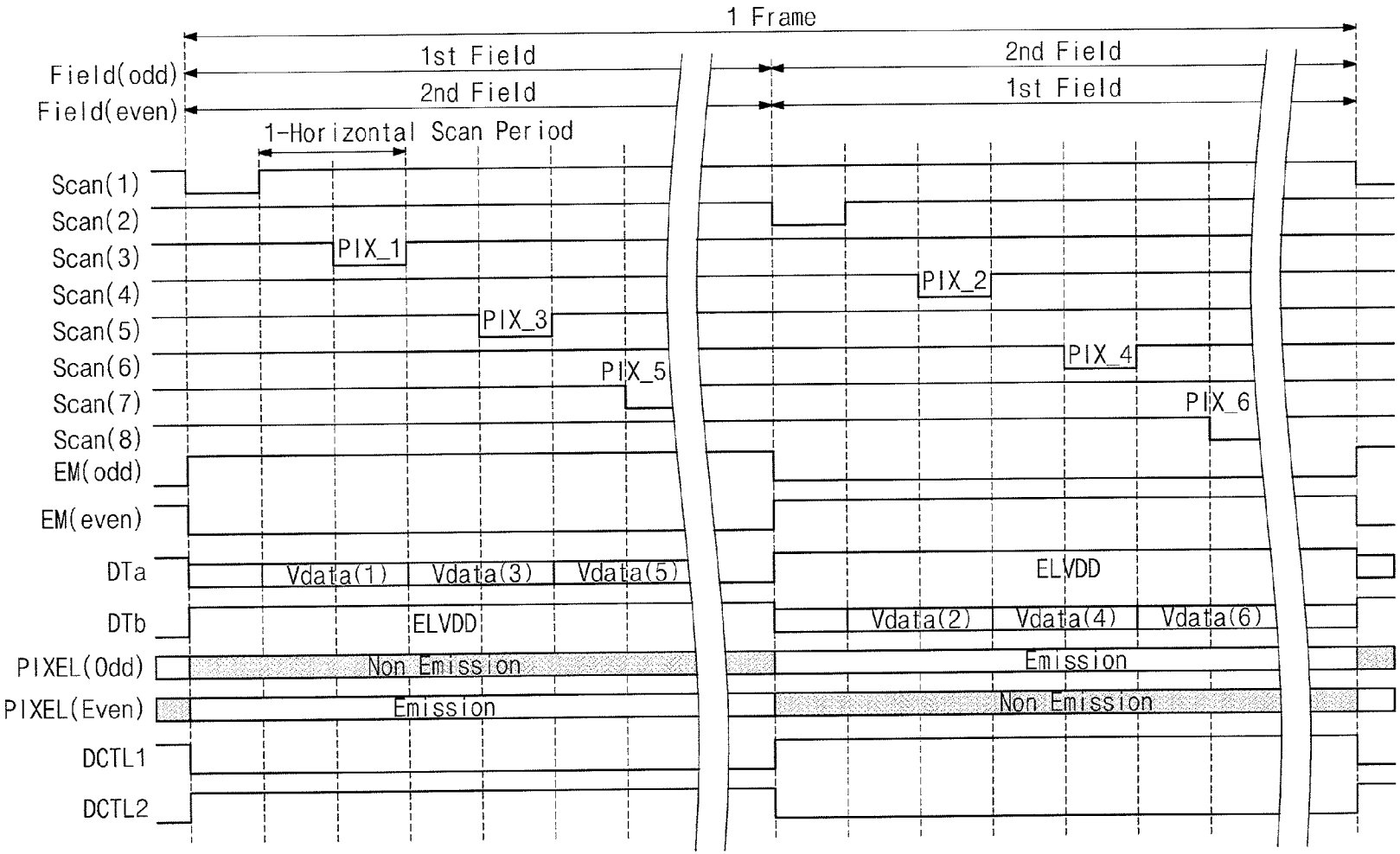
FIG. 6 illustrates an embodiment of a timing diagram for the display device.

FIG. 6 is an embodiment of a timing diagram for operating a light emitting display device including the pixel circuits previous described. Operations of the pixel circuits performed based on this timing diagram are described with reference to FIGS. 2 and 6.

Referring to FIG. 6, a 1-frame period is a period in which data writing and emission operations for all pixels circuits on the panel is performed. The 1-frame period includes a first field and a second field. The first field is or includes a gray scale data write period (non-emission period), and the second field is or includes an emission period.

In the first and second fields at the left side of FIG. 6, a gate control signal DCTL1 of switching circuit 40 has a low level and a gate control signal DCTL2 has a high level. Thus, a gray scale data voltage Vdata(n) is supplied as a data signal DTa, and an anode voltage ELVDD is supplied as a data signal DTb.

Because an emission control signal EM(odd) has a high level, emission transistors M4 of pixel circuits in odd-numbered rows are turned off. As a result, emission elements are at a non-emission state. The pixel circuits in the odd-numbered rows correspond to the first field. Because an emission control signal EM(even) has a low level, emission transistors M4 of pixel circuits in even-numbered rows are turned on. In this case, emission elements are at an emission state. The pixel circuits in the even-numbered rows correspond to the second field.

When one field ends, during first and second fields illustrated at a right side of FIG. 6, gate control signal DCTL1 of switching circuit 40 transitions to a high level and a gate control signal DCTL2 transitions to a low level. Thus, gray scale data voltage Vdata(n) is supplied as data signal DTb, and anode voltage ELVDD is supplied as data signal DTa.

Because emission control signal EM(odd) has a low level, emission transistors M4 of pixel circuits in the odd-numbered rows are turned on. As a result, the emission elements are in an emission state. The pixel circuits in odd-numbered rows correspond to the second field. Because emission control signal EM(even) has a high level, emission transistors M4 of the pixel circuits in the even-numbered rows are turned off. As a result, the emission elements are in a non-emission state. The pixel circuits in the even-numbered rows correspond to the first field.

A pixel circuit 100A at the first column and first row and a pixel circuit 100B at the first column and third row will be more fully described with reference to FIG. 6.

In the first field, a switch transistor M2 of pixel circuit 100A is turned on in response to a low level of gate control signal Scan1. Pixel circuit 100A is thereby initialized. For example, operation of pixel circuit 100A corresponds to an initialization period (A). Next, switch transistor M2 of pixel circuit 100A is turned off in response to a high level of gate control signal Scan1. As a result, an initialization period of pixel circuit 100A may be terminated.

Then, when gray scale data voltage Vdata1 is supplied as data signal DTa, a data line 33 is charged. Thus, operation of pixel circuit 100A may correspond to data line charging period (B).

As switch transistor M3 of pixel circuit 100A turns on in response to a low level of gate control signal Scan3, a threshold voltage compensation operation is carried out. In the same period, switch transistor M2 of pixel circuit 100B turns on, to thereby initialize pixel circuit 100B. At this time, operation of pixel circuit 100A corresponds to a threshold voltage compensation period (C), and operation of pixel circuit 100B corresponds to an initialization period (A).

As switch transistor M3 of pixel circuit 100A turns off in response to a high level of gate control signal Scan3, a threshold voltage compensation operation is terminated. Also, in the same period, switch transistor M2 of pixel circuit 100B is turned off, to thereby terminate the initialization period of pixel circuit 100B. After the initialization operation, operation of pixel circuit 100B may be the same as that of pixel circuit 100A.

During periods (A) to (C) of pixel circuits in odd-numbered rows, pixel circuits in even-numbered rows operate as follows. An anode power supply voltage ELVDD is supplied to a data line, and emission transistor M4 is turned on in response to a low level of emission control signal EM(even). Thus, pixel circuits in even-numbered rows are in an emission state. Thus, operations of pixel circuits in the even-numbered rows may correspond to an emission period (D).

As described above, an initialization operation, a data line charging operation, and a threshold voltage compensation operation are carried out line-sequentially with respect to pixel circuits of odd-numbered rows on a panel. When gray scale data is written at pixel circuits of odd-numbered rows on the panel, switching from the first field to the second field is performed and anode power supply voltage ELVDD is supplied to pixel circuits of odd-numbered rows via data lines 33. Thus, emission elements may emit light. Operations of pixel circuits 100A and 100B in FIG. 2 may correspond to emission period (D).

In the first embodiment, in the first field, gray scale data is written at odd-numbered rows of pixel circuits and even-numbered rows of pixel circuits emit light. In the second field, gray scale data is written at even-numbered rows of pixel circuits and odd-numbered rows of pixel circuits emit light. Thus, a pixel circuit driving method according to the first embodiment is carried out such that even-numbered rows of pixel circuits and odd-numbered rows of pixel circuits emit light in turn, or alternately.

Figure 12:
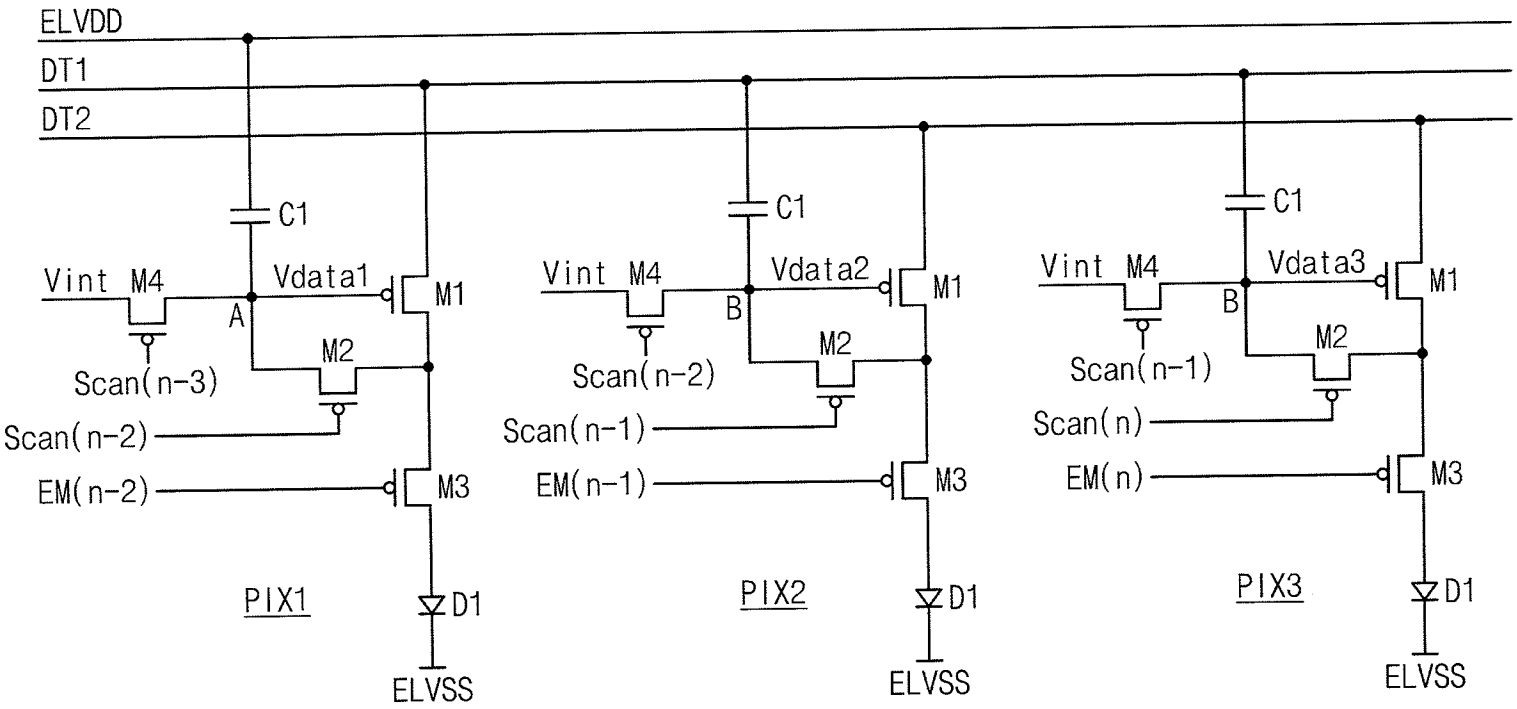
FIG. 12 Conventional Art
FIG. 12 illustrates a conventional light emitting display device.
Figure 13:
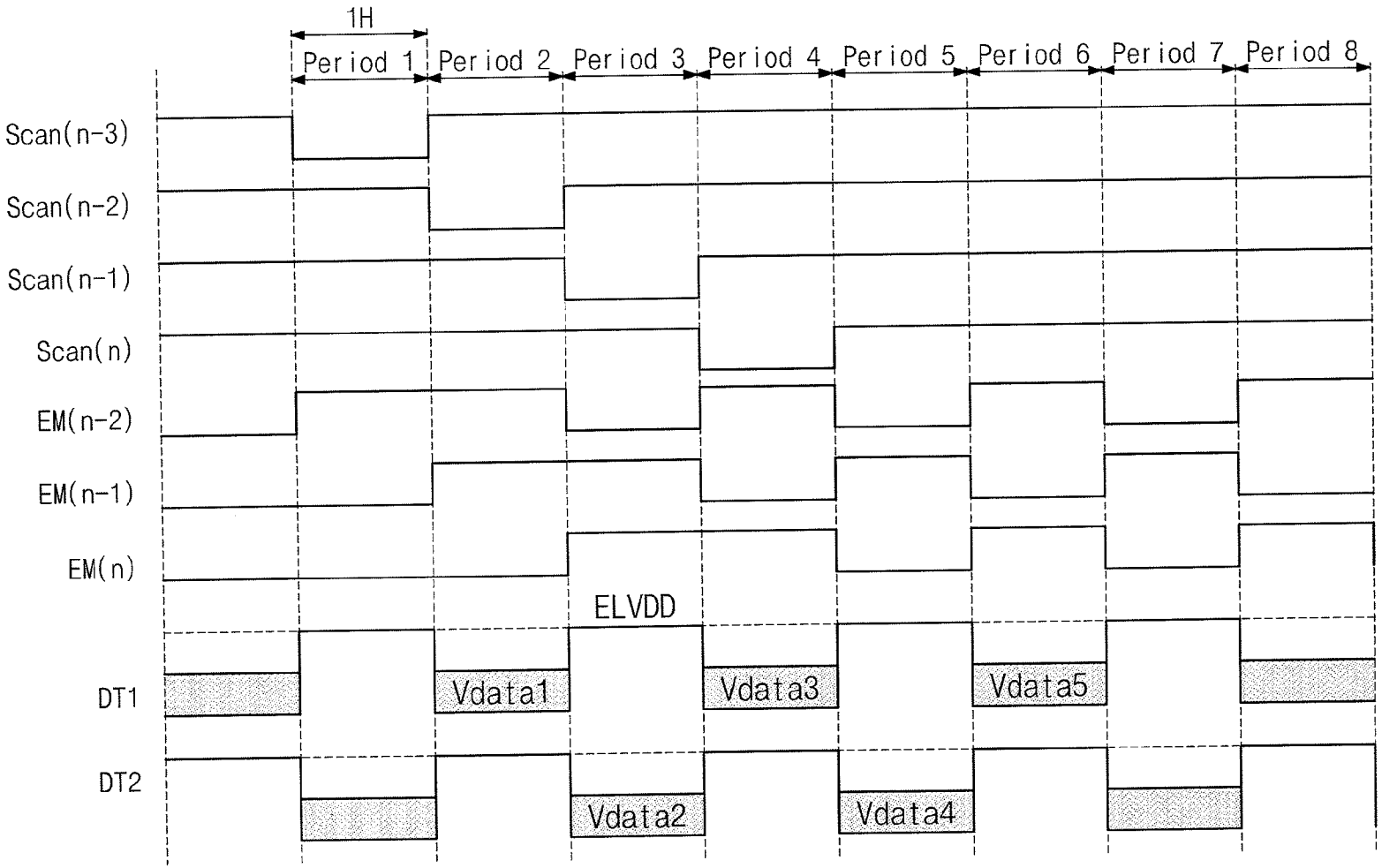
FIG. 13 Conventional Art
FIG. 13 illustrates a timing diagram for the conventional display device.

FIGS. 12 and 13 illustrate a circuit configuration and timing diagram of a conventional pixel circuit. The circuit configuration in FIG. 12 performs a driving operation for controlling emission and non-emission of light every odd-numbered row and even-numbered row. Because a data write operation is performed in an order of a first row, a second row, a third row . . . , emission and non-emission are switched every 1-horizontal period. Also, the conventional circuit configuration uses an EM signal every column, where the EM signal is a very complicated signal.

As compared with the conventional art pixel circuit, EM signals according to an embodiment are formed of two EM signals corresponding to an even-numbered row and an odd-numbered row. This structure simplifies the EM signal.

Because emission and non-emission of the pixel circuit are performed, in turn, every odd-numbered row and every even-numbered row in accordance with one embodiment, the number of emission control signals is reduced and the emission control signal becomes simple. Thus, the size of driving circuit may be reduced. Also, because a peripheral circuit is small, the edge of the display device becomes thin.

Figure 7:
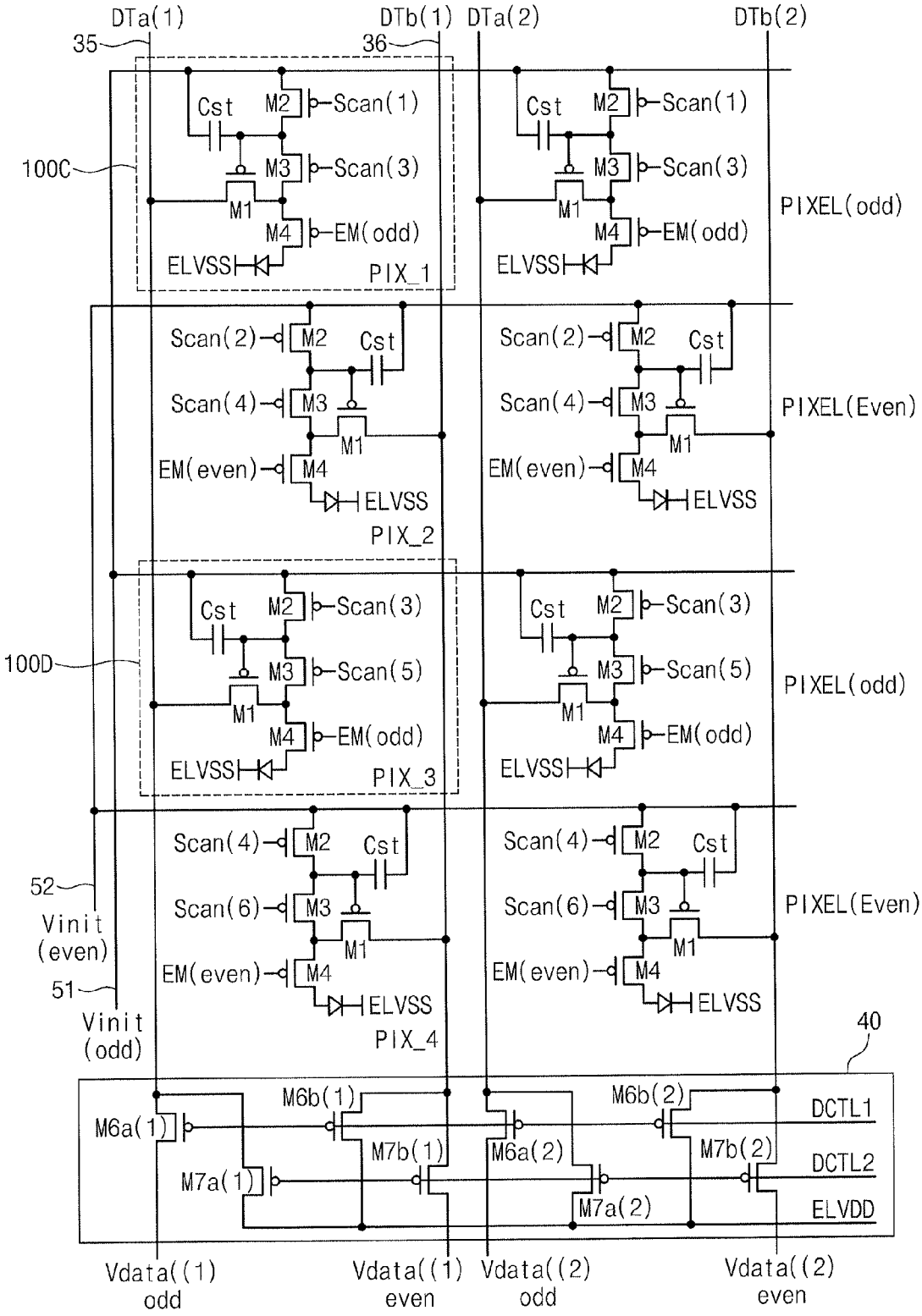
FIG. 7 illustrates another embodiment of a light emitting display device.

FIG. 7 illustrates another embodiment of a circuit configuration of a light emitting display device. Unlike the aforementioned embodiments, the light emitting display device includes two initialization signal lines 51 and 52. Odd-numbered rows of pixel circuits are connected to initialization signal line 51, and even-numbered rows of pixel circuits are connected to initialization signal line 52.

Figure 8:
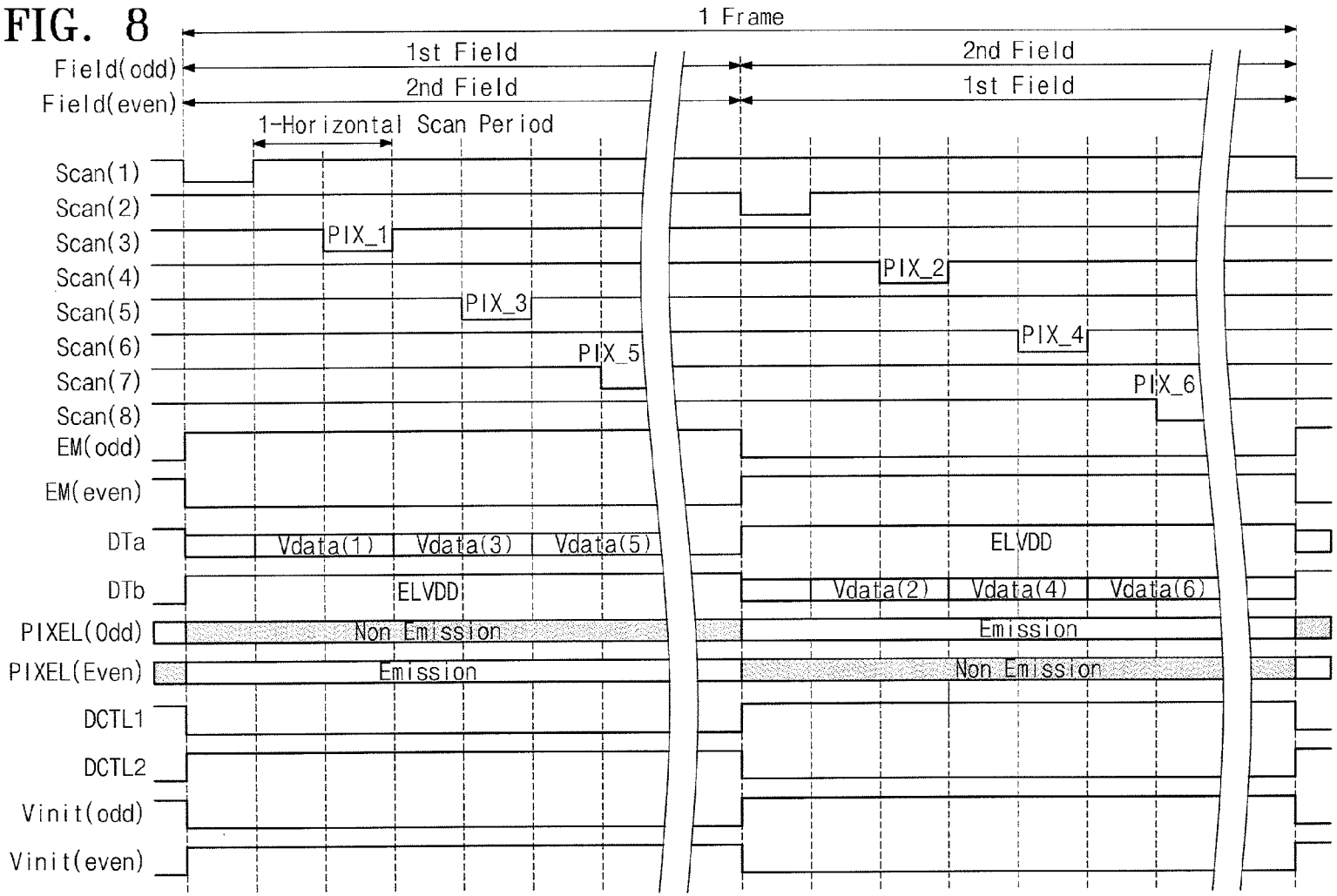
FIG. 8 illustrates another embodiment of a timing diagram for a display device.

FIG. 8 illustrates a timing diagram for controlling the light emitting display device in FIG. 7. The timing diagram of FIG. 8 is substantially the same as in FIG. 6, except for an initialization signal.

For example, as illustrated in FIG. 8, in a first field, an initialization signal Vinit(odd) connected to odd-numbered rows of pixel circuits has a low level. An initialization signal Vinit(even) connected to even-numbered rows of pixel circuits has a high level. In contrast, in a second field, the initialization signal Vinit(odd) connected to odd-numbered rows of pixel circuits has a high level, and the initialization signal Vinit(even) connected to even-numbered rows of pixel circuits has a low level.

Figure 9A:
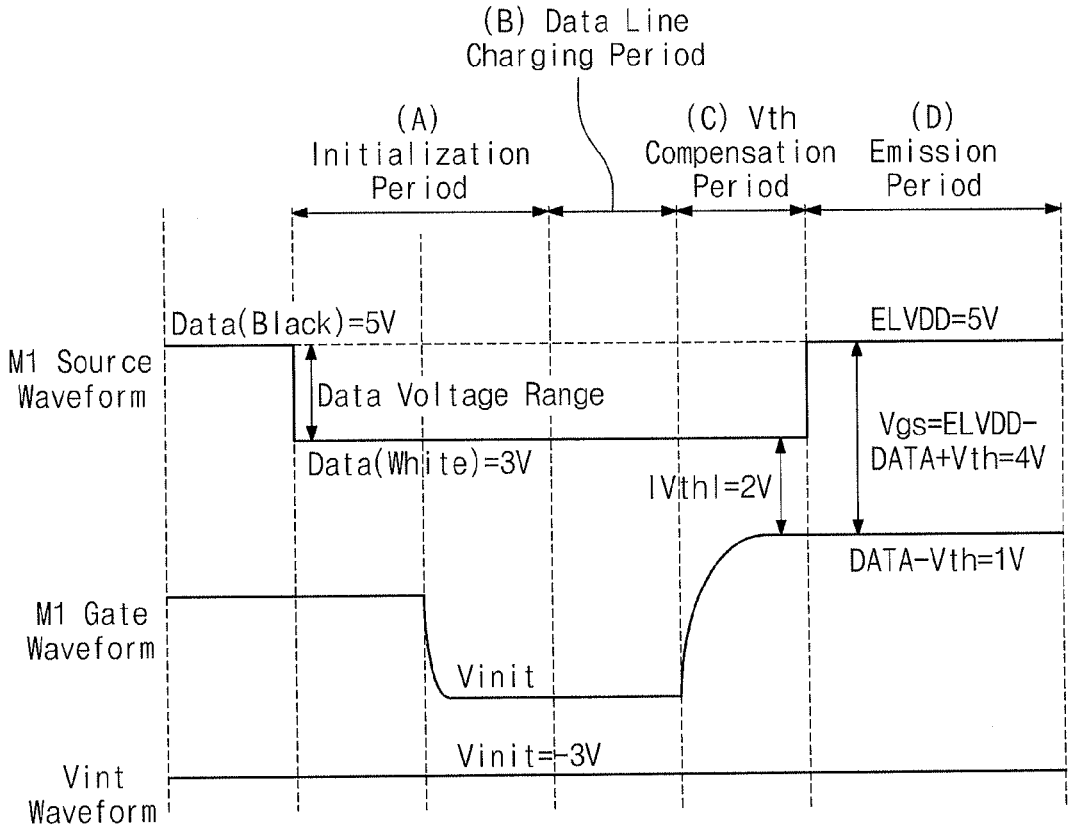
FIGS. 9A-9B illustrate another embodiment of timing diagrams of a unit pixel.
Figure 9B:
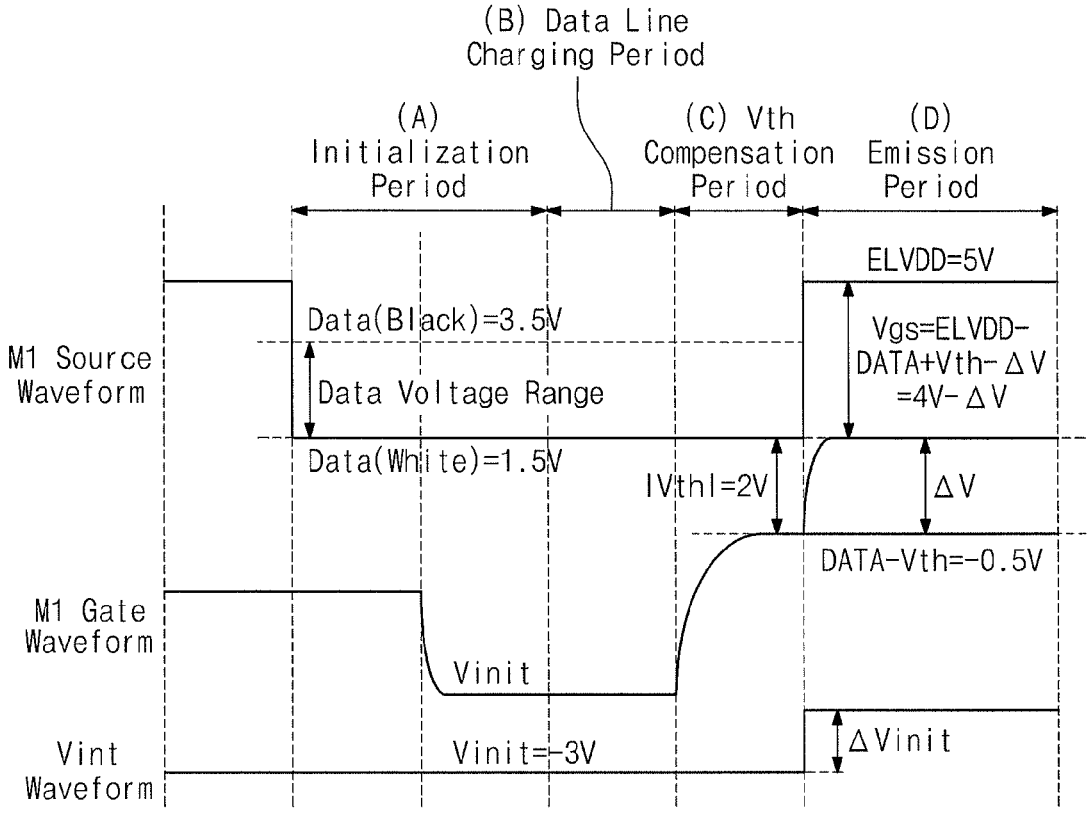

FIGS. 9A and 9B are timing diagrams of a unit pixel of the aforementioned embodiment of the light emitting display device. FIG. 9A illustrates an M1 source waveform, an M1 gate waveform, and a Vinit waveform of a unit pixel circuit. FIG. 9B illustrates an M1 source waveform, an M1 gate waveform, and a Vinit waveform of a unit pixel.

In FIG. 9A, a pixel circuit operates under condition that black data is set to 5 V and white data is set to 3 V. In FIG. 9A, it is assumed that black data is written at a pixel circuit. In this case, a gate-source voltage Vgs of driving transistor M1 may be 0 V, under assumption that a threshold voltage (e.g., −2 V) of the driving transistor M1 is fully compensated when an anode power supply voltage ELVDD and a black voltage all have 5 V. The driving transistor M1 is driven under a bias condition of Vgs=0 V, but an emission element emits light because a weak current is supplied to the emission element due to a leakage current. This phenomenon is referred to as a misadjusted black level, which causes a decrease in contrast.

In FIG. 9B, a pixel circuit operates under condition that black data is set to 3.5 V and white data is set to 1.5 V. In an emission period (D) of FIG. 9B, an initialization voltage Vint increases. As the initialization voltage Vint increases by ΔV, a potential of a gate electrode of driving transistor M1 coupled to capacitive element Cst increases by ΔV.

The amount of current of driving transistor M1 is reduced by increasing a potential of the gate electrode of driving transistor M1. Thus, it is possible to solve the above-described problem such as misadjusted black level. Also, power consumption of a data driving unit is reduced by setting a data voltage (i.e., a block-white voltage) at a low voltage domain.

As described above, a light emitting display device according to the foregoing embodiments may obtain an effect as other embodiments of a light emitting display device previously described. Further, because the light emitting display device changes the initialization voltage Vint to a high level during the emission period (D), a greater certainty of the driving transistor turning off may be attached and misadjusted black level may be suppressed.

Figure 10:
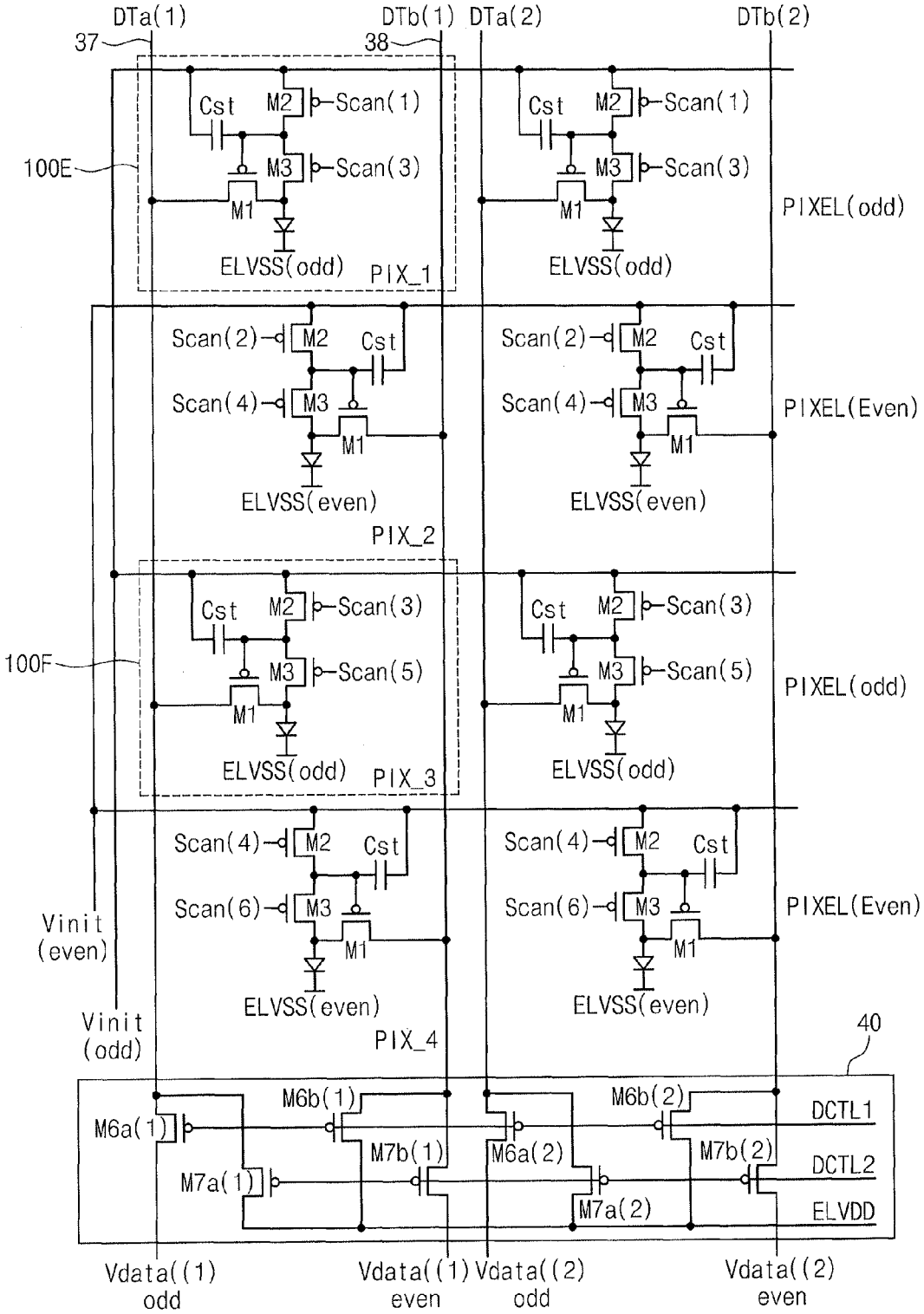
FIG. 10 illustrates another embodiment of light emitting display device.

FIG. 10 illustrates another embodiment of a light emitting display device. Unlike the light emitting display device shown in FIG. 7, the light emitting display device in FIG. 10 does not include emission transistors M4. Also, a cathode power supply voltage ELVSS(odd) is provided to odd-numbered rows, and a cathode power supply voltage ELVSS (even) is provided to even-numbered rows. In pixel circuits of the display device in FIG. 10, emission and non-emission of emission elements are controlled by changing a potential of the cathode power supply voltage ELVSS, instead of emission transistors.

Figure 11:
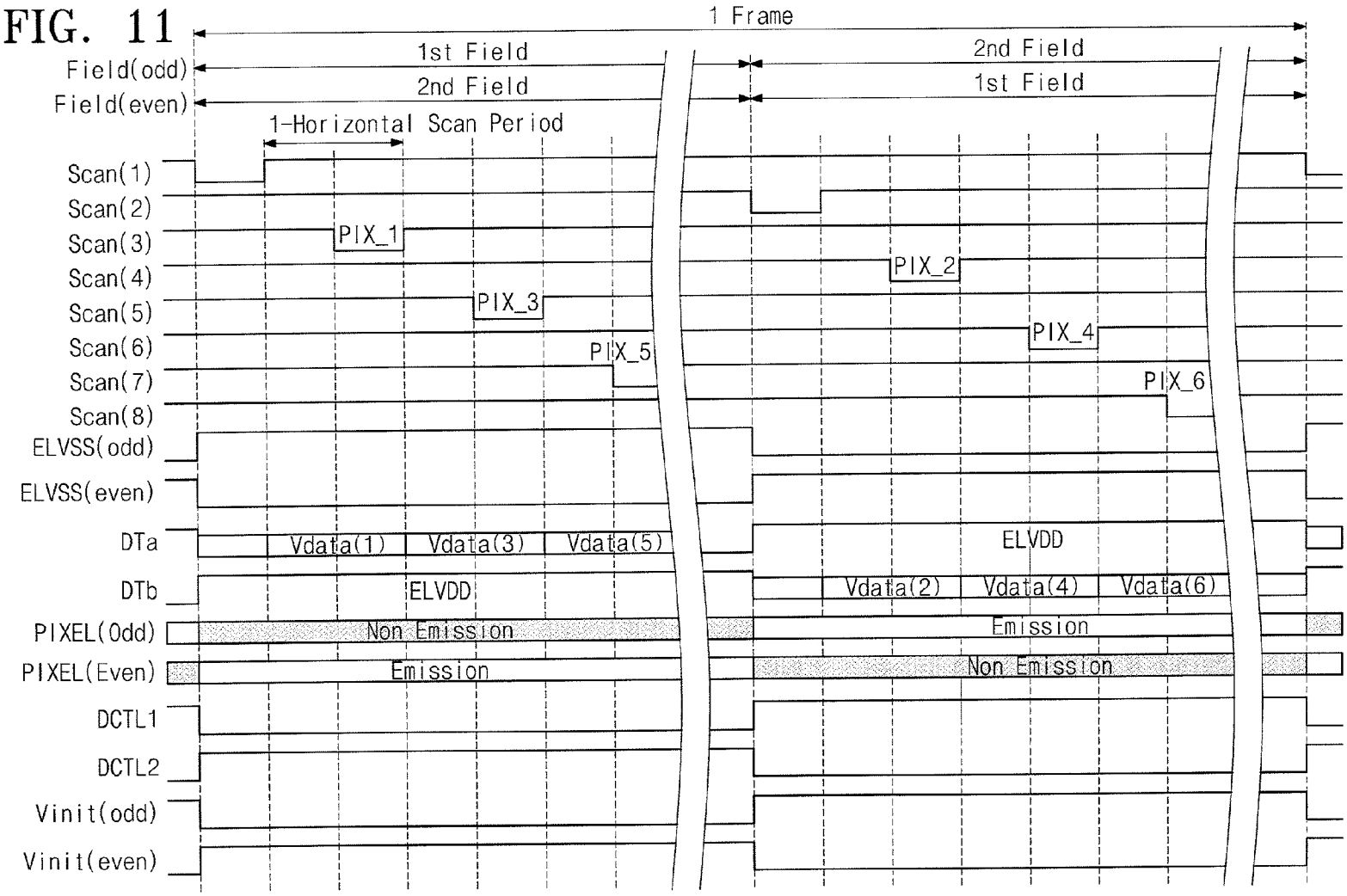
FIG. 11 illustrates a timing diagram for the display device in FIG. 10.

FIG. 11 is a timing diagram for controlling the light emitting display device shown in FIG. 10. The timing diagram in FIG. 11 is substantially the same as in FIG. 8, except emission control signals EM(odd) and EM(even) for controlling emission transistors do not exist, and ELVSS (odd) and ELVSS(even) for controlling a cathode power supply voltage ELVSS are added.

In the light emitting display device of FIG. 11, the cathode power supply voltage ELVSS(odd) is connected to odd-numbered rows of pixel circuits and the cathode power supply voltage ELVSS(even) is connected to even-numbered rows of pixel circuits. When odd-numbered rows of pixel circuits are driven by a non-emission state (first field) and even-numbered rows of pixel circuits are driven by an emission state (second field), the cathode power supply voltage ELVSS(odd) has a high level and the cathode power supply voltage ELVSS(even) has a low level. In this field, a voltage of (GD−ELVSS(odd)) (GD being gray scale data) is applied to emission elements to write the gray scale data at odd-numbered rows of pixel circuits. Thus, the emission elements are driven by a non-emission state, by setting the cathode power supply voltage ELVSS(odd) to a value greater than a maximum value of the gray scale data.

It is therefore possible to eliminate emission transistors by controlling the cathode power supply voltage ELVSS at an emission period and a non-emission period. Thus, the number of elements of a pixel circuit is reduced, an opening ratio is improved, and to implement high resolution is easy.

Like the embodiment in FIG. 7, the embodiment in FIG. 10 is configured such that an initialization voltage Vint is supplied to each even-numbered row and to each odd-numbered row. In an alternative embodiment, all pixel circuits may be connected to the same initialization voltage Vint. Also, the pixel circuit is shown to include p-channel transistors. In alternative embodiments, the pixel circuit may be formed of n-channel transistors or of n-channel transistors and p-channel transistors (CMOS-type).

In one or more of the aforementioned embodiments, a first field and a second field are allocated to odd-numbered rows of pixel circuits and even-numbered rows of pixel circuits. In alternative embodiments, a combination of rows controlled by a first field and a second field may be selected arbitrarily.

By way of summation and review, in the related art, a constant current circuit stabilizes current flowing into an organic EL circuit, to prevent display quality from being lowered due to variations in the characteristic of the driving transistor. A variation in a threshold voltage of a transistor may be suppressed by the constant current circuit. One technique for suppressing variations in the threshold voltage of a driving transistor using constant current circuit is referred to as a threshold voltage compensation technique.

A threshold voltage compensation circuit may control the amount of current to be supplied to a light emitting element only with input image data, and without dependence on a change in the threshold voltage of the driving transistor. Thus, it is possible to compensate for a change in the threshold voltage of the driving transistor and to improve display uniformity of the organic EL display.

However, a typical threshold voltage compensation circuit has six transistors and one capacitive element. As the number of elements in a pixel increases, it is difficult to implement high resolution. Also, the yield of products may be lowered.

According to one approach, a threshold voltage compensation circuit that has four transistors and one capacitive element. Because the number of elements in the threshold voltage compensation circuit is less than that included in a typical voltage compensation circuit (composed of six transistors and one capacitive element), the number of elements used per pixel may decrease. The aforementioned threshold voltage compensation circuit may therefore implement high resolution and improve the yield of products.

According to another approach, a pixel circuit may be progressively driven. An emission control signal for controlling a light emitting transistor is switched every 1 horizontal period. This complicates the control signal waveform.

In accordance with one of the aforementioned embodiments, a light emitting display device reduces the size of a driving circuit by simplifying a driving signal for emission. Also, the light emitting display device may have a slimmer edge. Also, in accordance with one of the aforementioned embodiments, because the light emitting display device suppresses a misadjusted black level, contrast may be significantly improved.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A method of driving a display device, the method comprising:

driving a first pixel circuit and a second pixel circuit based on a frame which includes a first field and a second field, the first field of the first pixel circuit overlapping the second field of the second pixel circuit, and the second field of the first pixel circuit overlapping the first field of the second pixel circuit, wherein:

operations performed during the first field include:

(a) supplying an initialization voltage to a gate electrode of a first transistor by turning on a fourth transistor, (b) supplying a gray scale data voltage to a data line, the gray scale data voltage applied to the gate electrode of the first transistor by turning on a second transistor, and (c) blocking supply of a power supply voltage to an emission element by turning off a third transistor, operations performed during the second field include:

(d) supplying the power supply voltage to the data line by turning on the third transistor, the emission element coupled to the data line to emit light based on the power supply voltage, wherein the first and second pixel circuits are in different rows, wherein the second transistor of a (N)th pixel circuit in an (N)th numbered row and the fourth transistor of a (N+2)th pixel circuit in (N+2)th numbered row are simultaneously controlled to be turned on, wherein, when the second transistor of the (N)th pixel circuit and the fourth transistor of the (N+2)th pixel circuit are simultaneously turned on, the supplying the gray scale data voltage to the gate electrode of the first transistor of the (N)th pixel circuit by turning on the second transistor and the supplying the initialization voltage to the gate electrode of the first transistor of the (N+2)th pixel circuit by turning on the fourth transistor of the (N+2)th pixel circuit are executed at the same time.

2. The method as claimed in claim 1, wherein:

each of the first and second pixel circuits include a capacitive element connected between the gate electrode of the first transistor and the initialization voltage, the initialization voltage includes a first initialization voltage supplied in the first field and a second initialization voltage supplied in the second field, and the method further comprises changing the second initialization voltage to vary a potential of the gate electrode of the first transistor connected to the capacitive element, to reduce an amount of current flowing through the first transistor.

3. The method as claimed in claim 2, wherein:

the first pixel circuit is in an odd-numbered row, and the second pixel circuit in an even-numbered row.

4. A method of driving a display device, the method comprising:

driving a first pixel circuit and a second pixel circuit based on a frame which includes a first field and a second field, the first field of the first pixel circuit overlapping the second field of the second pixel circuit, and the second field of the first pixel circuit overlapping the first field of the second pixel circuit, wherein:

operations performed during the first field include:

(a) supplying an initialization voltage to a gate electrode of a first transistor by turning on a fourth transistor, (b) supplying a gray scale data voltage to a data line, the gray scale data voltage applied to the gate electrode of the first transistor by turning on a second transistor, and (c) controlling a first power supply voltage of a first state to place an emission element in a non-emission state, and operations performed during the second field include:

(d) supplying a second power supply voltage to the data line, and (e) controlling the first power supply voltage of in a second state to place the emission element in an emission state, wherein the first and second pixel circuits are in different rows, wherein the second transistor of a (N)th pixel circuit in an (N)th numbered row and the fourth transistor of a (N+2)th pixel circuit in (N+2)th numbered row are simultaneously controlled to be turned on, wherein, when the second transistor of the (N)th pixel circuit and the fourth transistor of the (N+2)th pixel circuit are simultaneously turned on, the supplying the gray scale data voltage to the gate electrode of the first transistor of the (N)th pixel circuit by turning on the second transistor and the supplying the initialization voltage to the gate electrode of the first transistor of the (N+2)th pixel circuit by turning on the fourth transistor of the (N+2)th pixel circuit are executed at the same time.

5. The method as claimed in claim 4, wherein:

each of the first and second pixel circuits include a capacitive element connected between the gate electrode of the first transistor and the initialization voltage.

the initialization voltage includes a first initialization voltage supplied during the first field and a second initialization voltage supplied during the second field, and the method further comprises changing a voltage of the second initialization voltage to vary a potential of the gate electrode of the first transistor connected to the capacitive element, to reduce an amount of current flowing through the first transistor.

6. The method as claimed in claim 5, wherein:

the first pixel circuit is in an odd-numbered row, and the second pixel circuit is in an even-numbered row.

7. A method of driving a display device, the method comprising:

driving a first pixel circuit based on first and second fields of a frame; and driving a second pixel circuit based on the first and second fields of the frame, the first field of the first pixel circuit overlapping the second field of the second pixel circuit, and the second field of the first pixel circuit overlapping the first field of the second pixel circuit, wherein operations performed in the first field include supplying an initialization voltage, compensating a threshold voltage, and storing a gray scale data voltage, wherein operations performed in the second field include supplying an amount of current to a light emitter based on the stored gray scale data voltage, and wherein the first and second pixel circuits are in different rows, wherein when a (N)th pixel circuit in an (N)th numbered row is driven by the first field and the threshold voltage of the (N)th pixel circuit is compensated, the initialization voltage is supplied to a (N+2)th pixel circuit in an (N+2)th numbered row.

8. The method as claimed in claim 7, wherein:

the first pixel circuit is in an odd row, and the second pixel circuit is in an even row.

9. The method as claimed in claim 7, wherein:

operations performed in the first field include supplying the gray scale data voltage to a data line, and operations performed in the second field include supplying a power source voltage to the data line.

10. The method as claimed in claim 9, wherein the data voltage is supplied to the data line based on a first gate control signal, and the power source voltage is supplied to the data line based on a second gate control voltage.

11. The method as claimed in claim 9, wherein:

the gray scale data voltage is supplied to the data line of the first pixel circuit in the first field when the power supply voltage is supplied to the data line of the second pixel circuit the second field, and the gray scale data voltage is supplied to the data line of the second pixel circuit in the first field when the power supply voltage is supplied to a data line of the first pixel circuit the second field.

12. An apparatus, comprising:

a first switching circuit to selectively output a first gray scale data voltage or a first power source voltage to a first pixel circuit in odd-numbered rows; and a second switching circuit to selectively output second gray scale data voltage or the first power source voltage to a second pixel circuit in even-numbered rows, wherein:

the first and second pixel circuits are in adjacent rows;

the first switching circuit is to output the first gray scale data voltage to the first pixel circuit in a first field while the second switching circuit is to output the first power source voltage to the second pixel circuit in a second field, the second switching circuit is to output the second gray scale data voltage to the second pixel circuit in the first field while the first switching circuit is to output the first power source voltage to the first pixel circuit in the second field, wherein the first field include supplying an initialization voltage, compensating a threshold voltage and storing a gray scale data voltage, wherein the second field include supplying an amount of current to a light emitter based on the stored gray scale data voltage, and wherein when a (N)th pixel circuit in an (N)th numbered row is driven by the first field and the threshold voltage of the (N)th pixel circuit is compensated, the initialization voltage is supplied to a (N+2)th pixel circuit in an (N+2)th numbered row.

13. The apparatus as claimed in claim 12, wherein the first switching circuit outputs the first gray scale data voltage and the second switching circuit outputs the first power source voltage based on a first control signal.

14. The apparatus as claimed in claim 12, wherein the first switching circuit outputs the first power source voltage and the second switching circuit outputs the second gray scale data voltage based on a second control signal.

15. The apparatus as claimed in 12, wherein:

the first pixel circuit is in a light emission state while the second pixel circuit is in a light non-emission state, and the first pixel circuit is in a light non-emission state when the second pixel circuit is in a light emission state.

16. The apparatus as claimed in claim 12, wherein each of the first pixel circuit and the second pixel circuit is placed in a light emission state based on a change in potential of a second power voltage source.

17. The apparatus as claimed in claim 12, wherein:

the first pixel circuit is to receive a first initialization voltage, and the second pixel circuit is to receive a second initialization voltage different from the first initialization voltage, the first and second initialization voltages to reset respective ones of the first and second pixel circuits.

18. The apparatus as claimed in claim 12, wherein the first and second pixel circuits are in a same column.

19. The apparatus as claimed in claim 12, further comprising:

a data driver including the first and second switching circuits.

20. The apparatus as claimed in 12, wherein a driving transistor of each of the first and second pixel circuits is placed in a diode-connected state based on respective gray scale data voltages.

* * * * *